US007188687B2

(12) United States Patent
Rudd et al.

(10) Patent No.: US 7,188,687 B2
(45) Date of Patent: Mar. 13, 2007

(54) DOWNHOLE FILTER

(75) Inventors: Wayne Rudd, Newcastle Upon Tyne (GB); Paul David Metcalfe, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/900,076

(22) Filed: Jul. 27, 2004

(65) Prior Publication Data

US 2005/0121232 A1 Jun. 9, 2005

Related U.S. Application Data

(63) Continuation-in-part of application No. 10/693,185, filed on Oct. 24, 2003, now Pat. No. 7,093,653, and a continuation-in-part of application No. 10/853,498, filed on May 25, 2004, now Pat. No. 7,117,957, which is a continuation of application No. 10/364,718, filed on Feb. 11, 2003, now Pat. No. 6,742,606, which is a continuation of application No. 09/469,643, filed on Dec. 22, 1999, now Pat. No. 6,543,552.

(30) Foreign Application Priority Data

Dec. 22, 1998 (GB) ..... 9828234.6
Oct. 25, 2002 (GB) ..... 0224807.8

(51) Int. Cl.
*E21B 43/10* (2006.01)

(52) U.S. Cl. ..... 175/171; 175/312; 166/207; 166/277

(58) Field of Classification Search ..... 166/278, 166/228, 236, 277, 207; 175/314, 171, 312

See application file for complete search history.

(56) References Cited

U.S. PATENT DOCUMENTS 65,276 A * 5/1867 Ricker ..... 175/19

(Continued)

FOREIGN PATENT DOCUMENTS

CA 2 335 192 11/2001

(Continued)

OTHER PUBLICATIONS

U.K. Search Report, Application No. GB0514214.6, dated Aug. 11, 2005.

(Continued)

*Primary Examiner*—Jennifer H. Gay
*Assistant Examiner*—Nicole A Coy
(74) *Attorney, Agent, or Firm*—Patterson & Sheridan, LLP

(57) ABSTRACT

A downhole filter comprises a tubular member having a wall defining a plurality of openings. The openings have an outer width less than an inner width. The parts of the opening defining the smaller width are defined by radially outer parts of the openings, such that particulates or sand prevented from passing through the openings will tend to be retained to the outside of the tubular member. A method comprises providing a tubular string having a non-porous tubular portion and a porous tubular portion, and installing the tubular string within a wellbore such that the porous tubular portion is located adjacent a fluid-producing formation within the wellbore. In another embodiment, an apparatus comprises a drill string comprising a non-porous tubular portion and a porous tubular portion, and an earth removal member operatively connected to a lower end of the drill string.

41 Claims, 6 Drawing Sheets

U.S. PATENT DOCUMENTS

| | | | | | |
|---|---|---|---|---|---|
| 98,766 | A | * | 1/1870 | Harter | 166/236 |
| 122,514 | A | | 1/1872 | Bullock | |
| 123,903 | A | * | 2/1872 | Hovey | 166/381 |
| 238,112 | A | * | 2/1881 | Halstead | 175/19 |
| 988,054 | A | | 3/1911 | Wiet | |
| 1,077,772 | A | | 11/1913 | Weathersby | |
| 1,185,582 | A | | 5/1916 | Bignell | |
| 1,233,888 | A | | 7/1917 | Leonard | |
| 1,301,285 | A | | 4/1919 | Leonard | |
| 1,338,460 | A | * | 4/1920 | Morrison | 175/70 |
| 1,342,424 | A | | 6/1920 | Cotten | |
| 1,418,766 | A | | 6/1922 | Wilson | |
| 1,471,526 | A | | 10/1923 | Pickin | |
| 1,585,069 | A | | 5/1926 | Youle | |
| 1,728,136 | A | | 9/1929 | Power | |
| 1,777,592 | A | | 10/1930 | Thomas | |
| 1,825,026 | A | | 9/1931 | Thomas | |
| 1,830,625 | A | | 11/1931 | Schrock | |
| 1,842,638 | A | | 1/1932 | Wigle | |
| 1,851,289 | A | | 3/1932 | Owen | |
| 1,880,218 | A | | 10/1932 | Simmons | |
| 1,917,135 | A | | 7/1933 | Littell | |
| 1,981,525 | A | | 11/1934 | Price | |
| 1,998,833 | A | | 4/1935 | Crowell | |
| 2,017,451 | A | | 10/1935 | Wickersham | |
| 2,049,450 | A | | 8/1936 | Johnson | |
| 2,060,352 | A | | 11/1936 | Stokes | |
| 2,102,555 | A | | 12/1937 | Dyer | |
| 2,105,885 | A | | 1/1938 | Hinderliter | |
| 2,167,338 | A | | 7/1939 | Murcell | |
| 2,214,226 | A | | 9/1940 | English | |
| 2,214,429 | A | | 9/1940 | Miller | |
| 2,216,895 | A | | 10/1940 | Stokes | |
| 2,228,503 | A | | 1/1941 | Boyd et al. | |
| 2,295,803 | A | | 9/1942 | O'Leary | |
| 2,305,062 | A | | 12/1942 | Church et al. | |
| 2,324,679 | A | | 7/1943 | Cox | |
| 2,370,832 | A | | 3/1945 | Baker | |
| 2,379,800 | A | | 7/1945 | Hare | |
| 2,383,214 | A | | 8/1945 | Prout et al. | |
| 2,414,719 | A | | 1/1947 | Cloud | |
| 2,424,878 | A | | 7/1947 | Crook | |
| 2,499,630 | A | | 3/1950 | Clark | |
| 2,519,116 | A | | 8/1950 | Crake | |
| 2,522,444 | A | | 9/1950 | Grable | |
| 2,536,458 | A | | 1/1951 | Munsinger | |
| 2,610,690 | A | | 9/1952 | Beatty | |
| 2,621,742 | A | | 12/1952 | Brown | |
| 2,627,891 | A | | 2/1953 | Clark | |
| 2,633,374 | A | | 3/1953 | Boice | |
| 2,641,444 | A | | 6/1953 | Moon | |
| 2,650,314 | A | | 8/1953 | Hennigh et al. | |
| 2,663,073 | A | | 12/1953 | Bieber et al. | |
| 2,668,689 | A | | 2/1954 | Cormany | |
| 2,692,059 | A | | 10/1954 | Bolling, Jr. | |
| 2,720,267 | A | | 10/1955 | Brown | |
| 2,738,011 | A | | 3/1956 | Mabry | |
| 2,741,907 | A | | 4/1956 | Genender et al. | |
| 2,743,087 | A | | 4/1956 | Layne et al. | |
| 2,743,495 | A | | 5/1956 | Eklund | |
| 2,764,329 | A | | 9/1956 | Hampton | |
| 2,765,146 | A | | 10/1956 | Williams | |
| 2,805,043 | A | | 9/1957 | Williams | |
| 2,953,406 | A | | 9/1960 | Young | |
| 2,978,047 | A | | 4/1961 | DeVaan | |
| 3,006,415 | A | | 10/1961 | Burns et al. | |
| 3,028,915 | A | | 4/1962 | Jennings | |
| 3,039,530 | A | | 6/1962 | Condra | |
| 3,041,901 | A | | 7/1962 | Knights | |
| 3,054,100 | A | | 9/1962 | Jones | |
| 3,087,546 | A | | 4/1963 | Wooley | |
| 3,090,031 | A | | 5/1963 | Lord | |
| 3,102,599 | A | | 9/1963 | Hillburn | |
| 3,111,179 | A | | 11/1963 | Albers et al. | |
| 3,117,636 | A | | 1/1964 | Wilcox et al. | |
| 3,122,811 | A | | 3/1964 | Gilreath | |
| 3,123,160 | A | | 3/1964 | Kammerer | |
| 3,124,023 | A | | 3/1964 | Marquis et al. | |
| 3,131,769 | A | | 5/1964 | Rochemont | |
| 3,159,219 | A | | 12/1964 | Scott | |
| 3,167,122 | A | | 1/1965 | Lang | |
| 3,169,592 | A | | 2/1965 | Kammerer | |
| 3,179,168 | A | | 4/1965 | Vincent | |
| 3,186,485 | A | | 6/1965 | Owen | |
| 3,191,677 | A | | 6/1965 | Kinley | |
| 3,191,680 | A | | 6/1965 | Vincent | |
| 3,193,116 | A | | 7/1965 | Kenneday, et al. | |
| 3,203,451 | A | | 8/1965 | Vincent | |
| 3,203,483 | A | | 8/1965 | Vincent | |
| 3,245,471 | A | | 4/1966 | Howard | |
| 3,297,092 | A | | 1/1967 | Jennings | |
| 3,326,293 | A | | 6/1967 | Skipper | |
| 3,353,599 | A | | 11/1967 | Swift | |
| 3,354,955 | A | | 11/1967 | Berry | |
| 3,380,528 | A | | 4/1968 | Timmons | |
| 3,387,893 | A | | 6/1968 | Hoever | |
| 3,392,609 | A | | 7/1968 | Bartos | |
| 3,419,079 | A | | 12/1968 | Current | |
| 3,477,506 | A | | 11/1969 | Malone | |
| 3,477,527 | A | | 11/1969 | Koot | |
| 3,489,220 | A | | 1/1970 | Kinley | |
| 3,518,903 | A | | 7/1970 | Ham et al. | |
| 3,548,936 | A | | 12/1970 | Kilgore et al. | |
| 3,550,684 | A | | 12/1970 | Cubberly, Jr. | |
| 3,552,507 | A | | 1/1971 | Brown | |
| 3,552,508 | A | | 1/1971 | Brown | |
| 3,552,509 | A | | 1/1971 | Brown | |
| 3,552,510 | A | | 1/1971 | Brown | |
| 3,552,848 | A | | 1/1971 | Van Wagner | |
| 3,559,739 | A | | 2/1971 | Hutchison | |
| 3,566,505 | A | | 3/1971 | Martin | |
| 3,570,598 | A | | 3/1971 | Johnson | |
| 3,575,245 | A | | 4/1971 | Cordary et al. | |
| 3,583,200 | A | | 6/1971 | Cvijanovic et al. | |
| 3,602,302 | A | | 8/1971 | Kluth | |
| 3,603,411 | A | | 9/1971 | Link | |
| 3,603,412 | A | | 9/1971 | Kammerer, Jr. et al. | |
| 3,603,413 | A | | 9/1971 | Grill et al. | |
| 3,606,664 | A | | 9/1971 | Weiner | |
| 3,621,910 | A | | 11/1971 | Sanford | |
| 3,624,760 | A | | 11/1971 | Bodine | |
| 3,635,105 | A | | 1/1972 | Dickmann et al. | |
| 3,656,564 | A | | 4/1972 | Brown | |
| 3,662,842 | A | | 5/1972 | Bromell | |
| 3,669,190 | A | | 6/1972 | Sizer et al. | |
| 3,680,412 | A | | 8/1972 | Mayer et al. | |
| 3,689,113 | A | | 9/1972 | Blaschke | |
| 3,691,624 | A | | 9/1972 | Kinley | |
| 3,691,825 | A | | 9/1972 | Dyer | |
| 3,692,126 | A | | 9/1972 | Rushing et al. | |
| 3,696,332 | A | | 10/1972 | Dickson, Jr. et al. | |
| 3,700,048 | A | | 10/1972 | Desmoulins | |
| 3,712,376 | A | | 1/1973 | Owen et al. | |
| 3,729,057 | A | | 4/1973 | Werner | |
| 3,746,091 | A | | 7/1973 | Owen et al. | |
| 3,746,330 | A | | 7/1973 | Taciuk | |
| 3,747,675 | A | | 7/1973 | Brown | |
| 3,760,894 | A | | 9/1973 | Pitifer | |
| 3,766,991 | A | | 10/1973 | Brown | |
| 3,776,307 | A | | 12/1973 | Young | |
| 3,776,320 | A | | 12/1973 | Brown | |
| 3,780,562 | A | | 12/1973 | Kinley | |
| 3,785,193 | A | | 1/1974 | Kinley et al. | |
| 3,808,916 | A | | 5/1974 | Porter et al. | |

3,820,370 A 6/1974 Duffy
3,838,613 A 10/1974 Wilms
3,840,128 A 10/1974 Swoboda, Jr. et al.
3,848,684 A 11/1974 West
3,857,450 A 12/1974 Guier
3,870,114 A 3/1975 Pulk et al.
3,881,375 A 5/1975 Kelly
3,885,679 A 5/1975 Swoboda, Jr. et al.
3,901,331 A 8/1975 Djurovic
3,913,687 A 10/1975 Gyongyosi et al.
3,915,244 A 10/1975 Brown
3,934,660 A 1/1976 Nelson
3,945,444 A 3/1976 Knudson
3,947,009 A 3/1976 Nelmark
3,948,321 A 4/1976 Owen et al.
3,964,556 A 6/1976 Gearhart et al.
3,977,076 A 8/1976 Vieira et al.
3,980,143 A 9/1976 Swartz et al.
4,049,066 A 9/1977 Richey
4,054,332 A 10/1977 Bryan, Jr.
4,054,426 A 10/1977 White
4,064,939 A 12/1977 Marquis
4,077,525 A 3/1978 Callegari et al.
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,927 A 12/1978 Hauk et al.
4,133,396 A 1/1979 Tschirky
4,142,739 A 3/1979 Billingsley
4,173,457 A 11/1979 Smith
4,175,619 A 11/1979 Davis
4,186,628 A 2/1980 Bonnice
4,189,185 A 2/1980 Kammerer, Jr. et al.
4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,311,195 A 1/1982 Mullins, II
4,315,553 A 2/1982 Stallings
4,319,393 A 3/1982 Pogonowski
4,320,915 A 3/1982 Abbott et al.
4,336,415 A 6/1982 Walling
4,349,050 A 9/1982 Bergstrom et al.
4,359,889 A 11/1982 Kelly
4,362,324 A 12/1982 Kelly
4,382,379 A 5/1983 Kelly
4,384,627 A 5/1983 Ramirez-Jauregui
4,387,502 A 6/1983 Dom
4,392,534 A 7/1983 Miida
4,396,076 A 8/1983 Inoue
4,396,077 A 8/1983 Radtke
4,407,150 A 10/1983 Kelly
4,407,378 A 10/1983 Thomas
4,408,669 A 10/1983 Wiredal
4,413,682 A 11/1983 Callihan et al.
4,414,739 A 11/1983 Kelly
4,427,063 A 1/1984 Skinner
4,437,363 A 3/1984 Haynes
4,440,220 A 4/1984 McArthur
4,445,201 A 4/1984 Pricer
4,445,734 A 5/1984 Cunningham
4,446,745 A 5/1984 Stone et al.
4,449,596 A 5/1984 Boyadjieff
4,450,612 A 5/1984 Kelly
4,460,053 A 7/1984 Jurgens et al.
4,463,814 A 8/1984 Horstmeyer et al.
4,466,498 A 8/1984 Bardwell
4,470,280 A 9/1984 Kelly
4,470,470 A 9/1984 Takano
4,472,002 A 9/1984 Beney et al.
4,474,243 A 10/1984 Gaines
4,483,399 A * 11/1984 Colgate ..... 166/308.1
4,487,630 A 12/1984 Crook et al.
4,489,793 A 12/1984 Boren
4,489,794 A 12/1984 Boyadjieff
4,492,134 A 1/1985 Reinhldt et al.
4,494,424 A 1/1985 Bates
4,502,308 A 3/1985 Kelly
4,505,142 A 3/1985 Kelly
4,505,612 A 3/1985 Shelley, Jr.
4,515,045 A 5/1985 Gnatchenko et al.
4,526,230 A * 7/1985 Kojicic ..... 166/236
4,529,045 A 7/1985 Boyadjieff et al.
4,544,041 A 10/1985 Rinaldi
4,545,443 A 10/1985 Wiredal
4,567,631 A 2/1986 Kelly
4,570,706 A 2/1986 Pugnet
4,580,631 A 4/1986 Baugh
4,581,617 A 4/1986 Yoshimoto et al.
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,610,320 A 9/1986 Beakley
4,613,161 A 9/1986 Brisco
4,620,600 A 11/1986 Persson
4,625,796 A 12/1986 Boyadjieff
4,626,129 A 12/1986 Kothmann et al.
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.

4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,807,704 A 2/1989 Hsu et al.
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,844,182 A * 7/1989 Tolle ..... 175/215
4,848,469 A 7/1989 Baugh et al.
4,854,386 A 8/1989 Baker et al.
4,866,966 A 9/1989 Hagen
4,867,236 A 9/1989 Haney et al.
4,878,546 A 11/1989 Shaw et al.
4,880,058 A 11/1989 Lindsey et al.
4,883,121 A 11/1989 Zwart
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,965,822 A 10/1990 Pascale
4,976,322 A 12/1990 Abdrakhmanov et al.
4,997,042 A 3/1991 Jordan et al.
4,997,320 A 3/1991 Hwang
5,009,265 A 4/1991 Bailey et al.
5,014,779 A 5/1991 Meling et al.
5,022,472 A 6/1991 Bailey et al.
5,027,914 A 7/1991 Wilson
5,031,699 A 7/1991 Artynov et al.
5,036,927 A 8/1991 Willis
5,049,020 A 9/1991 McArthur
5,052,483 A 10/1991 Hudson
5,052,849 A 10/1991 Zwart
5,059,256 A * 10/1991 Kanapenas et al. .... 219/121.71
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,209 A 10/1992 McHardy
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,267,613 A 12/1993 Zwart et al.
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,301,760 A 4/1994 Graham
5,305,830 A 4/1994 Wittrisch
5,305,839 A 4/1994 Kalsi et al.
5,307,879 A 5/1994 Kent
5,318,122 A 6/1994 Murray et al.
5,320,178 A * 6/1994 Cornette ..... 175/19
5,322,127 A 6/1994 McNair et al.
5,323,858 A 6/1994 Jones et al.
5,332,043 A 7/1994 Ferguson
5,332,048 A 7/1994 Underwood et al.
5,337,838 A 8/1994 Sorensen
5,340,182 A 8/1994 Busink et al.
5,343,950 A 9/1994 Hale et al.
5,343,951 A 9/1994 Cowan et al.
5,348,095 A * 9/1994 Worrall et al. ..... 166/380
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,366,012 A * 11/1994 Lohbeck ..... 166/277
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,409,059 A 4/1995 McHardy
5,433,279 A 7/1995 Tassari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,426 A 10/1996 Trahan et al.

5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,611,397 A 3/1997 Wood
5,613,567 A 3/1997 Hudson
5,615,747 A 4/1997 Vail, III
5,636,661 A 6/1997 Moyes
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A * 9/1997 Gill et al. ..... 166/295
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,755,299 A 5/1998 Langford, Jr. et al.
5,772,514 A 6/1998 Moore
5,785,120 A 7/1998 Smalley et al.
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrel et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,901,789 A * 5/1999 Donnelly et al. ..... 166/381
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,924,745 A * 7/1999 Campbell ..... 285/90
5,931,231 A 8/1999 Mock
5,947,213 A 9/1999 Angle et al.
5,950,742 A 9/1999 Caraway
5,954,131 A 9/1999 Sallawasser
5,957,225 A 9/1999 Sinor
5,960,881 A 10/1999 Allamon et al.
5,960,895 A 10/1999 Chevallier et al.
5,971,079 A 10/1999 Mullins
5,971,086 A 10/1999 Bee et al.
5,979,571 A 11/1999 Scott et al.
5,984,007 A 11/1999 Yuan et al.
5,984,568 A * 11/1999 Lohbeck ..... 403/375
5,988,273 A 11/1999 Monjure et al.
6,000,472 A 12/1999 Albright et al.
6,012,522 A 1/2000 Donnelly et al.
6,012,523 A 1/2000 Campbell et al.
6,012,529 A 1/2000 Mikolajczyk et al.
6,024,169 A 2/2000 Haugen
6,026,911 A 2/2000 Angle et al.
6,029,748 A 2/2000 Forsyth et al.
6,035,953 A 3/2000 Rear
6,050,341 A 4/2000 Metcalf
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,085,838 A 7/2000 Vercaemer et al.
6,089,323 A 7/2000 Newman et al.
6,098,717 A 8/2000 Bailey et al.
6,112,818 A 9/2000 Campbell
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,273,634 B1 8/2001 Lohbeck
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,040 B1 * 11/2001 Donnelly ..... 166/207
6,315,051 B1 11/2001 Ayling
6,325,148 B1 12/2001 Trahan et al.

6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,425,444 B1 7/2002 Metcalfe et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,323 B1 9/2002 Metcalfe et al.
6,446,723 B1 9/2002 Ramons et al.
6,454,013 B1 9/2002 Metcalfe
6,457,532 B1 10/2002 Simpson
6,457,533 B1 10/2002 Metcalfe
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,523,611 B1 * 2/2003 Bakker et al. ..... 166/298
6,527,047 B1 3/2003 Pietras
6,527,049 B2 3/2003 Metcalfe et al.
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,545 B1 4/2003 Chatterji et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,571,672 B1 6/2003 Rudd
6,585,040 B2 7/2003 Hanton et al.
6,591,471 B1 7/2003 Hollingsworth et al.
6,595,288 B2 7/2003 Mosing et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,029 B2 3/2004 Metcalfe et al.
6,702,040 B1 3/2004 Sensenig
6,708,769 B2 3/2004 Haugen et al.
6,715,430 B2 4/2004 Choi et al.
6,715,570 B1 * 4/2004 Downton et al. ..... 175/314
6,719,071 B1 4/2004 Moyes
6,722,443 B1 * 4/2004 Metcalfe ..... 166/384
6,722,559 B1 4/2004 Millar et al.
6,725,924 B2 4/2004 Davidson et al.
6,725,938 B1 4/2004 Pietras
6,732,822 B2 5/2004 Slack et al.
6,742,584 B1 6/2004 Appleton
6,742,596 B2 6/2004 Haugen
6,742,606 B2 6/2004 Metcalfe et al.
6,745,834 B2 6/2004 Davis et al.
6,752,211 B2 6/2004 Dewey et al.
6,776,233 B2 8/2004 Meehan
6,832,656 B2 12/2004 Fournier, Jr. et al.
6,832,658 B2 12/2004 Keast
6,837,313 B2 1/2005 Hosie et al.
6,840,322 B2 1/2005 Haynes et al.
6,845,820 B1 1/2005 Hebert et al.
6,848,517 B2 2/2005 Wardley
6,854,533 B2 * 2/2005 Galloway et al. ..... 175/22
6,857,486 B2 2/2005 Chitwood et al.
6,857,487 B2 2/2005 Galloway
6,868,906 B1 3/2005 Vail, III et al.
6,877,553 B2 4/2005 Cameron
6,889,772 B2 5/2005 Buytaert et al.
6,892,835 B2 5/2005 Shahin et al.
6,896,075 B2 5/2005 Haugen et al.
6,899,186 B2 5/2005 Galloway et al.
6,941,652 B2 * 9/2005 Echols et al. ..... 29/896.62
7,108,083 B2 9/2006 Simonds et al.
2001/0013427 A1 * 8/2001 Mocivnik et al. ..... 175/230
2001/0042625 A1 11/2001 Appleton
2002/0040787 A1 4/2002 Cook et al.
2002/0066556 A1 6/2002 Goode et al.
2002/0108748 A1 8/2002 Keyes
2002/0170720 A1 11/2002 Haugen
2002/0189863 A1 12/2002 Wardley
2003/0029641 A1 2/2003 Meehan
2003/0056991 A1 3/2003 Hahn et al.
2003/0070841 A1 4/2003 Merecka et al.
2003/0111267 A1 6/2003 Pia
2003/0141111 A1 7/2003 Pia
2003/0146023 A1 8/2003 Pia
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0217865 A1 11/2003 Simpson et al.
2003/0221519 A1 12/2003 Haugen et al.
2004/0003490 A1 1/2004 Shahin et al.
2004/0003927 A1 * 1/2004 Rudd ..... 166/382
2004/0003944 A1 1/2004 Vincent et al.
2004/0011534 A1 1/2004 Simonds et al.
2004/0050591 A1 * 3/2004 Downton et al. ..... 175/312
2004/0060697 A1 4/2004 Titton et al.
2004/0069500 A1 4/2004 Haugen
2004/0108142 A1 6/2004 Vail, III
2004/0112603 A1 6/2004 Galloway et al.
2004/0112646 A1 6/2004 Vail
2004/0118613 A1 6/2004 Vail
2004/0118614 A1 6/2004 Galloway et al.
2004/0123984 A1 7/2004 Vail
2004/0124010 A1 7/2004 Galloway et al.
2004/0124011 A1 7/2004 Gledhill et al.
2004/0124015 A1 7/2004 Vaile et al.
2004/0129456 A1 7/2004 Vail
2004/0140128 A1 7/2004 Vail
2004/0144547 A1 7/2004 Koithan et al.
2004/0168799 A1 * 9/2004 Simonds et al. ..... 166/278

| | | | |
|---|---|---|---|
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0096846 | A1 | 5/2005 | Koithan et al. |
| 2005/0121232 | A1 | 6/2005 | Rudd et al. |
| 2005/0152749 | A1 | 7/2005 | Anres et al. |

FOREIGN PATENT DOCUMENTS

| | | | |
|---|---|---|---|
| DE | 3213464 | A1 | 10/1983 |
| DE | 3 523 221 | | 2/1987 |
| DE | 3 918 132 | | 12/1989 |
| DE | 4133802 | C1 | 10/1992 |
| EP | 0 087 373 | | 8/1983 |
| EP | 0 162 000 | | 11/1985 |
| EP | 0 171 144 | | 2/1986 |
| EP | 0 235 105 | | 9/1987 |
| EP | 0 265 344 | | 4/1988 |
| EP | 0 285 386 | | 10/1988 |
| EP | 0 426 123 | | 5/1991 |
| EP | 0 462 616 | | 12/1991 |
| EP | 0 474 481 | | 3/1992 |
| EP | 0 479 583 | | 4/1992 |
| EP | 0 525 247 | | 2/1993 |
| EP | 0 554 568 | | 8/1993 |
| EP | 0 571 045 | | 11/1993 |
| EP | 0 589 823 | | 3/1994 |
| EP | 0 659 975 | | 6/1995 |
| EP | 0 790 386 | | 8/1997 |
| EP | 0 881 354 | | 4/1998 |
| EP | 0 952 305 | A1 | 4/1998 |
| EP | 0 961 007 | | 12/1999 |
| EP | 0 962 384 | | 12/1999 |
| EP | 1 006 260 | | 6/2000 |
| EP | 1 050 661 | | 11/2000 |
| EP | 1148206 | | 10/2001 |
| EP | 1 256 691 | | 11/2002 |
| EP | 1 413 709 | | 4/2004 |
| FR | 2053088 | | 7/1970 |
| FR | 2741907 | | 6/1997 |
| FR | 2 841 293 | | 12/2003 |
| GB | 540 027 | | 10/1941 |
| GB | 730338 | | 3/1954 |
| GB | 709 365 | | 5/1954 |
| GB | 716 761 | | 10/1954 |
| GB | 792886 | | 4/1956 |
| GB | 8 388 33 | | 6/1960 |
| GB | 881 358 | | 11/1961 |
| GB | 997721 | | 7/1965 |
| GB | 1277461 | | 6/1972 |
| GB | 1 306 568 | | 3/1973 |
| GB | 1448304 | | 9/1976 |
| GB | 1457843 | | 12/1976 |
| GB | 1 469 661 | | 4/1977 |
| GB | 1582392 | | 1/1981 |
| GB | 2 053 088 | | 2/1981 |
| GB | 2 115 940 | | 9/1983 |
| GB | 2 170 528 | | 8/1986 |
| GB | 2 201 912 | | 9/1988 |
| GB | 2216926 | A | 10/1989 |
| GB | 2 223 253 | | 4/1990 |
| GB | 2 221 482 | | 7/1990 |
| GB | 2 224 481 | | 9/1990 |
| GB | 2 240 799 | | 8/1991 |
| GB | 2 275 488 | | 4/1993 |
| GB | 2313860 | B | 6/1996 |
| GB | 2 294 715 | | 8/1996 |
| GB | 2322655 | A | 2/1998 |
| GB | 2 320 270 | | 6/1998 |
| GB | 2 324 108 | | 10/1998 |
| GB | 2329918 | A | 4/1999 |
| GB | 2 333 542 | | 7/1999 |
| GB | 2 335 217 | | 9/1999 |
| GB | 2 381 809 | | 5/2000 |
| GB | 2 345 074 | | 6/2000 |
| GB | 2 347 445 | | 9/2000 |
| GB | 2 348 223 | | 9/2000 |
| GB | 2 349 401 | | 11/2000 |
| GB | 2 350 137 | | 11/2000 |
| GB | 2 357 101 | | 6/2001 |
| GB | 2 357 530 | | 6/2001 |
| GB | 2 352 747 | | 7/2001 |
| GB | 2 365 463 | | 2/2002 |
| GB | 2 372 271 | | 8/2002 |
| GB | 2 372 765 | | 9/2002 |
| GB | 2 382 361 | | 5/2003 |
| GB | 2 386 626 | | 9/2003 |
| GB | 2 389 130 | | 12/2003 |
| RU | 2 079 633 | | 5/1997 |
| SU | 112631 | | 1/1956 |
| SU | 247162 | | 5/1967 |
| SU | 395557 | | 8/1973 |
| SU | 415346 | | 2/1974 |
| SU | 461218 | | 2/1975 |
| SU | 481689 | | 8/1975 |
| SU | 501139 | | 1/1976 |
| SU | 581238 | | 11/1977 |
| SU | 583278 | | 12/1977 |
| SU | 585266 | | 12/1977 |
| SU | 601390 | | 4/1978 |
| SU | 655843 | | 4/1979 |
| SU | 781312 | | 11/1980 |
| SU | 899820 | | 1/1982 |
| SU | 1113530 | | 9/1984 |
| SU | 1 618 870 | | 1/1991 |
| SU | 1808972 | | 4/1993 |
| SU | 955765 | | 1/1995 |
| SU | 1304470 | | 1/1995 |
| WO | WO 91-06418 | | 6/1990 |
| WO | WO 91-16520 | | 10/1991 |
| WO | WO 92/01139 | | 1/1992 |
| WO | WO 92-18743 | | 10/1992 |
| WO | WO 92-20899 | | 11/1992 |
| WO | WO 93-07358 | | 4/1993 |
| WO | WO 93/24728 | | 12/1993 |
| WO | WO 93/25800 | | 12/1993 |
| WO | WO 94/25655 | | 11/1994 |
| WO | WO 95-10686 | | 4/1995 |
| WO | WO 96/01250 | | 1/1996 |
| WO | WO 96-18799 | | 6/1996 |
| WO | WO 96/03261 | | 8/1996 |
| WO | WO 96-28635 | | 9/1996 |
| WO | WO 97-05360 | | 2/1997 |
| WO | WO 97-08418 | | 3/1997 |
| WO | WO 97/17524 | | 5/1997 |
| WO | WO 97/21901 | | 6/1997 |
| WO | WO 98/00626 | | 1/1998 |
| WO | WO 98-01651 | | 1/1998 |
| WO | WO 98-05844 | | 2/1998 |
| WO | WO 98-09053 | | 3/1998 |
| WO | WO 98-11322 | | 3/1998 |
| WO | WO 98-32948 | | 7/1998 |
| WO | WO 98-55730 | | 12/1998 |
| WO | WO 99/02818 | | 1/1999 |
| WO | WO 99-04135 | | 1/1999 |
| WO | WO 99-11902 | | 3/1999 |

| | | |
|---|---|---|
| WO | WO 99/18328 | 4/1999 |
| WO | WO 99-24689 | 5/1999 |
| WO | WO 99-35368 | 7/1999 |
| WO | WO 99-37881 | 7/1999 |
| WO | WO 99-41485 | 8/1999 |
| WO | WO 99-50528 | 10/1999 |
| WO | WO 99-58810 | 11/1999 |
| WO | WO 99-64713 | 12/1999 |
| WO | WO 00-04269 | 1/2000 |
| WO | WO 00-05483 | 2/2000 |
| WO | WO 00-08293 | 2/2000 |
| WO | WO 00-09853 | 2/2000 |
| WO | WO 00-11309 | 3/2000 |
| WO | WO 00-11310 | 3/2000 |
| WO | WO 00-11311 | 3/2000 |
| WO | WO 00-28188 | 5/2000 |
| WO | WO 00-37766 | 6/2000 |
| WO | WO 00-37771 | 6/2000 |
| WO | WO 00-39429 | 7/2000 |
| WO | WO 00-39430 | 7/2000 |
| WO | WO 00-41487 | 7/2000 |
| WO | WO 00-46484 | 8/2000 |
| WO | WO 00-50730 | 8/2000 |
| WO | WO 00/50732 | 8/2000 |
| WO | WO 00-66879 | 11/2000 |
| WO | WO 01-12946 | 2/2001 |
| WO | WO 01-46550 | 6/2001 |
| WO | WO 01-79650 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02-14649 | 2/2002 |
| WO | WO 02-44601 | 6/2002 |
| WO | WO 02-081863 | 10/2002 |
| WO | WO 02-086287 | 10/2002 |
| WO | WO 03-006790 | 1/2003 |
| WO | WO 03-074836 | 9/2003 |
| WO | WO 03-087525 | 10/2003 |
| WO | WO 04-022903 | 3/2004 |

OTHER PUBLICATIONS

U.S. Appl. No. 10/189,570, filed Jun. 6, 2002.
U.S. Appl. No. 10/618,093, filed Jul. 11, 2003.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydrautically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.

Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the-Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens. SPE, Garret Madell, SPE, Directional Drilling With Casing. SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.
Metcalfe, P.—"Expandable Slotted Tubes Offer Well Design Benefits", *Petroleum Engineer International*, vol. 69, No. 10 (Oct. 1996), pp. 60-63—XP000684479.

* cited by examiner

DOWNHOLE FILTER

CROSS-REFERENCE TO RELATED APPLICATIONS

This application is a continuation-in-part of U.S. patent application Ser. No. 10/693,185 filed Oct. 24, 2003 now U.S. Pat. No. 7,093,653, which is herein incorporated by reference in its entirety. U.S. patent application Ser. No. 10/693,185 claims benefit of Great Britain Patent Application No. 0224807.8 filed Oct. 25, 2002, which is also herein incorporated by reference in its entirety.

This application is also a continuation-in-part of U.S. patent application Ser. No. 10/853,498 filed on May 25, 2004, which is herein incorporated by reference in its entirety. U.S. patent application Ser. No. 10/853,498 is a continuation of U.S. patent application Ser. No. 10/364,718 filed on Feb. 11, 2003, now U.S. Pat. No. 6,742,606, which is herein incorporated by reference in its entirety. U.S. patent application Ser. No. 10/364,718 is a continuation of U.S. patent application Ser. No. 09/469,643 filed on Dec. 22, 1999, now U.S. Pat. No. 6,543,552, which is herein incorporated by reference in its entirety. U.S. patent application Ser. No. 09/469,643 claims benefit of Great Britain Application No. 9828234.6 filed on Dec. 22, 1998, which is also herein incorporated by reference in its entirety.

BACKGROUND OF THE INVENTION

1. Field of the Invention

The present invention relates to downhole filters, methods of filtering production fluid downhole, and methods of producing downhole filters. Embodiments of the invention relate to downhole filters, such as sand screens, for use in preventing sand or other particulates entrained in production fluid from passing from a producing formation into a wellbore.

2. Description of the Related Art

It is generally desirable that fluids extracted from downhole formations, such as oil and gas produced from hydrocarbon-bearing formations, are substantially free from particulates, or sand. The presence of sand in the production fluid can lead to blockages, premature wear and damage to valves, pumps and the like. Produced sand which has been separated from the produced fluid at surface requires storage and disposal, which can be difficult and expensive, particularly in offshore operations. Furthermore, unchecked production of sand from a formation can result in substantial damage to the formation itself.

Perhaps the most common means for restricting sand production involves the provision of a mechanical sand control device, installed downhole, that causes the sand to bridge or filters the produced liquids or gases. These devices come in many forms, including slotted liners and wire-wrapped screens. The simplest slotted liner is made of oilfield pipe that has been longitudinally slotted with a precision saw or mill. Such liner is relatively inexpensive, and is accordingly preferred for wells having long completion intervals, but does not have high-inlet-flow areas, and may therefore be unsuitable for high-rate wells. Wire-wrapped screens consist of keystone-shaped corrosion-resistant wire wrapped around a drilled or slotted mandrel, the wire being spaced from the mandrel by longitudinal ribs to allow for maximum flow through the screen.

Other sand control devices comprise a filter sheet sandwiched between a perforated base pipe and a perforated outer shroud. By providing the filter sheet in the form of a plurality of overlapping leaves, and providing a diametrically expandable base pipe and outer shroud, it is possible to provide an expandable sand control device, such as is sold under the ESS trade mark by the applicant. In this particular arrangement, overlapping leaves of non-expanding apertured metal filter sheet are sandwiched between a slotted expandable base pipe and a slotted expandable protective shroud. Each leaf is attached to the base pipe along an axially extending weld, and the free edges of the leaves then overlapped to provide an iris-like arrangement. On expansion of the filter, the leaves of filter sheet slide over one another, the circumferential extent of each leaf being selected such that a degree of overlap remains in the expanded configuration, such that there is a continuous wrapping of filter sheet.

While such expandable filter arrangements have been used successfully on many occasions, manufacture of the arrangements is relatively difficult and expensive, and the location and relative movement of the filter sheets during the expansion process introduces a risk of the filter sheets tearing. When installing the sand control device as a completion string within the wellbore, the outer shroud may tear upon coming into contact with an obstruction within the wellbore, rendering the sand control device ineffective for its desired purpose. Installing a filter arrangement downhole is especially problematic when it is desired to drill to the desired depth within the formation using the filter arrangement, as the outer shroud is especially prone to tearing upon portions of the formation while drilling.

Embodiments of the various aspects of the present invention provide alternative sand control devices.

SUMMARY OF THE INVENTION

According to embodiments of the present invention there is provided a downhole filter comprising a tubular member having a wall defining a plurality of openings, at least a portion of one or more openings having an outer width less than an inner width. Thus, the parts of the openings defining the smaller width are defined by radially outer parts of the openings, such that particulates or sand prevented from passing through the openings will tend to be retained to the outside of the tubular member.

Preferably, said outer width defines the minimum width of the openings. Preferably, said portions of one or more openings defining said outer width are located on or adjacent an outer circumference of the tubular member.

Conveniently, the openings have a keystone form, that is the openings are of generally trapezoidal section, or wedge-shaped section. However, the openings may take any appropriate form, including a nozzle-like form having convex side walls or other forms having rectilinear or non-rectilinear side walls. Keystone-form openings may be created by laser-cutting, abrasive water jet cutting, or indeed by any conventional cutting or milling techniques.

The form of openings present in the walls of tubular members in accordance with these embodiments of the present invention is of course unlike the form of openings that would be achieved if a normally apertured planar sheet, in which openings have parallel walls, is rolled into a tubular form, which tends to create openings in which the inner width of the openings is less than the outer width. Furthermore, conventional slotted liner, made of oilfield pipe that has been longitudinally slotted with a precision saw or mill, will feature parallel side walls and will tend to have an outer length greater than an inner length. Thus this aspect of the invention provides the preferred form of openings for sand exclusion such as is achieved in wire-wrapped screens, but without the complexity and expense associated with wire-wrapped screens, and in a relatively robust form.

The openings may be of any desired configuration or orientation, or combination of configurations or orientations, including longitudinally extending openings or slots, circumferentially extending openings or slots, helically extending openings or slots, or serpentine openings or slots which may have a wave or step-form.

Preferably, the tubular member is self-supporting such that the member may be handled, and preferably also run into and installed in a bore, without requiring the provision of an additional support member or members. Most preferably, the tubular member incorporates end couplings, to allow the tubular member to be incorporated in a string of tubulars. The tubular member may feature threaded end portions, such as pin and box connections, or may have ends adapted to co-operate with coupling sleeves. The number and form of the openings may be determined with a view to providing the tubular member with a desired strength, and crush resistance, and as such will depend upon, for example, the wall thickness of the tubular member, the diameter of the member, the material from which the member is formed, and whether the member has been or will be heat-treated, cold worked, or its material properties otherwise altered or modified.

In other embodiments, the tubular member may be provided in combination with one or more other tubular members located internally or externally thereof, which other tubular members may serve a support or protection function, or may provide a filtering function. One embodiment of the invention includes an inner support pipe, within the tubular member, but is absent any external protective shroud.

In certain embodiments the tubular member may be diametrically expandable. Such expansion may be accommodated in a number of ways, for example the wall of the member may extend or otherwise deform, which may involve a change in the form of the openings. In one embodiment, the wall of the tubular member may incorporate extendible portions, such as described in our PCT\GB2003\001718, the disclosure of which is incorporated by reference. However, a preferred extensible tubular member features substantially circular openings which, following diametric expansion, assume a circumferentially-extending slot-form of smaller width than the original openings. Preferably, the original openings are laser-cut.

According to another aspect of the present invention there is provided a wellbore filter comprising a tubular member having a plurality of openings therethrough, the openings having a serpentine configuration.

Aspects of the present invention also relate to methods of filtering wellbore fluids, one method comprising placing a downhole filter within a wellbore, with the downhole filter comprising a tubular member having a wall defining a plurality of openings, at least a portion of one or more openings having an outer width less than an inner width, with the outer width sized to filter wellbore particulate matter; and passing wellbore fluids into an interior passage of the tubular member through the openings. According to a yet further aspect of the present invention there is provided a downhole filter arrangement comprising a metal tubular member defining a plurality of laser-cut perforations.

Existing tubular members are slotted to create filters using a precision saw or mill. The use of a precision cutting tool is necessary to provide the accurately controlled slot width required to provide an effective filter with predictable sand control properties. However, the applicant has now achieved the previously unattainable accuracy required of filter slots or openings by laser-cutting. Conventionally, a slot cut by laser has a larger width at the slot ends, where cutting commenced and stopped, producing "dog-bone" slots, which are of little if any utility in filter applications. A conventional laser cutting operation utilises a substantially constant laser energy input, and when cutting commences the laser is held stationary relative to the workpiece until the laser has cut through the depth of the metal, before moving along the workpiece to cut the slot, and then coming to a stop at the end of the slot. Applicant believes that, without wishing to be bound by theory, where the laser is held stationary relative to the workpiece, energy transfer to the workpiece from the laser creates a pool of molten metal surrounding the area of metal which is removed by vaporisation, and this pool of molten metal is removed from the workpiece with the vaporised metal. This has the effect that the width of cut is increased relative to areas where the laser is moving relative to the workpiece, and where less metal is removed by this mechanism. The applicant has found that it is possible to avoid this problem by controlling the laser energy during the cutting process, and more particularly by reducing the laser energy when the laser is stationary relative to the workpiece. By doing so it has been possible to cut slots of consistent width, suitable for use in filtering applications. Other techniques may be utilised to control slot width, including reducing the flow rate of purging gas, and thus reducing the rate of removal of molten metal. Alternatively, or additionally, a pulsed laser may be used, which laser produces discrete energy pulses such that, in use, a laser spot is not focussed on the workpiece for a time which is sufficient to allow thermal energy to be conducted into the metal surrounding the cutting zone.

There are a number of advantages gained by utilising laser to cut the perforations. Firstly, the perforations may be of forms other than those achievable by means of a conventional rotating cutting tool, and in particular it is possible to cut narrow slots of a serpentine form. Secondly, laser cutting tools may operate in conjunction with a gas purge, which carries away the vaporised and molten metal, and cools the surrounding material. An oxygen purge may be utilised to help the exothermic reaction at high temperatures, but for the present application an inert gas purge is preferred. However, in addition to merely cooling the metal, the gas purge jet has been found to produce a quenching effect at the edges of the cut, tending to increase the hardness of the metal surrounding the cut, particularly the outer edges of the perforations. Of course this is the area of the perforation which is likely to have to withstand the greatest erosion.

According to another aspect of the present invention there is provided a method of creating a downhole filter arrangement comprising laser-cutting a plurality of perforations in a metal filter member. According to a still further aspect of the present invention there is provided an expandable downhole filter arrangement comprising an expandable base tube and a deformable metal filter sheet mounted around the base tube, the filter sheet defining a plurality of laser-cut perforations.

Surprisingly, it has been found that relatively thin laser-perforated metal filter sheet may be deformed, and in particular extended, with minimal risk of tearing. It has been found that the perforations, which are typically originally substantially circular, tend to deform on diametric expansion of the filter sheet to assume the form of elongate slots of width less than the diameter of the original perforations.

Laser-cut perforations tend to have a keystone or trapezoidal section, and the filter sheet is preferably arranged such that the smaller diameter end of each perforation in the filter sheet is adjacent the outer face of the sheet. It has been found that the laser-perforated sheet is sufficiently robust to obviate the requirement to provide a protective shroud around the exterior of the sheet, thus simplifying the manufacture of the expandable filter arrangement and allowing installation of the laser-perforated sheet within the wellbore without the tear-prone protective shroud. The laser-perforated sheet may be initially provided in planar form, and then wrapped or otherwise formed around the base tube. The edges of the sheet may be joined by any convenient method, such as a seam weld.

In another aspect, embodiments of the present invention provide a method of completing a wellbore, comprising providing a tubular string, a first portion of the tubular string comprising one or more non-porous tubulars and a second portion of the tubular string comprising one or more porous tubulars; and installing the tubular string within the wellbore such that the second portion is located adjacent a fluid-producing formation within the wellbore. In yet another aspect, embodiments of the present invention include an apparatus for use in drilling and completing a wellbore, comprising a drill string, a first portion of the drill string comprising one or more non-porous tubulars and a second portion of the drill string comprising one or more porous tubulars; and an earth removal member operatively connected to a lower end of the drill string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
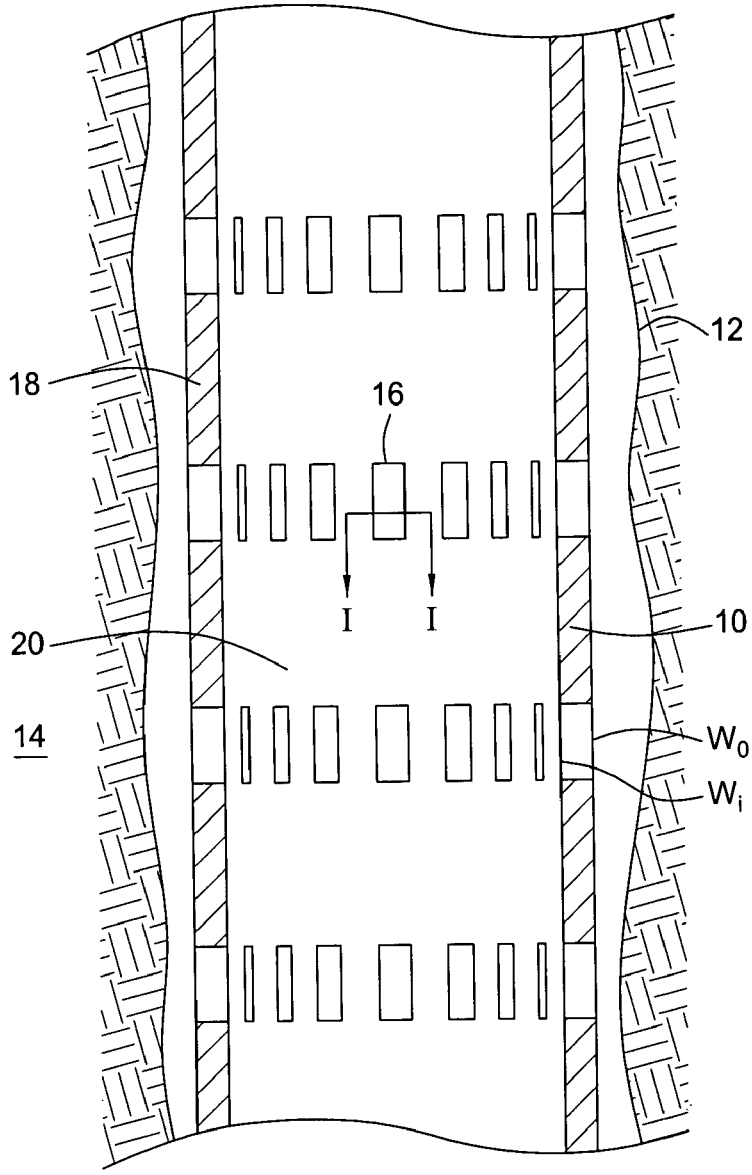
FIG. 1 is a schematic sectional view of part of a downhole filter in accordance with an embodiment of one aspect of the present invention, the filter shown located in a wellbore.

Reference is first made to FIG. 1 of the drawings, which is a schematic sectional view of a sand control device in the form of downhole filter 10, in accordance with an embodiment of an aspect of the present invention. The filter 10 is shown located in a wellbore 12 which has been drilled from surface to intersect a sand-producing hydrocarbon-bearing formation 14.

Figure 1A:
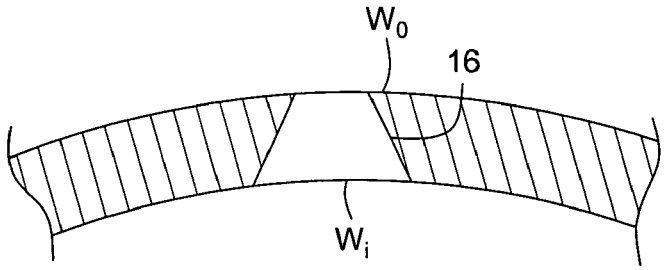
FIG. 1*a* is an enlarged schematic sectional view on line I—I of FIG. 1.

The filter 10 comprises a metal tubular in which a large number of longitudinally-extending slots 16 have been cut. The slots 16 have a keystone or trapezoidal form, that is the width of the slots increases from the exterior of the tubular wall $W_0$ to the interior $W_1$. This feature is shown in FIG. 1*a*, which is an enlarged sectional view of a slot 16 through line I—I of FIG. 1. As shown, the inner slot width $W_1$ is greater than the outer slot width $W_0$. The outer, minimum width $W_0$ is selected to be smaller than the diameter of the particulates it is desired to prevent from passing from the formation 14, through the tubular wall 18, and into the tubular bore 20 (those of skill in the art will of course realize that the dimensions of the slots 16, in this and other figures, have been exaggerated).

Figure 2:
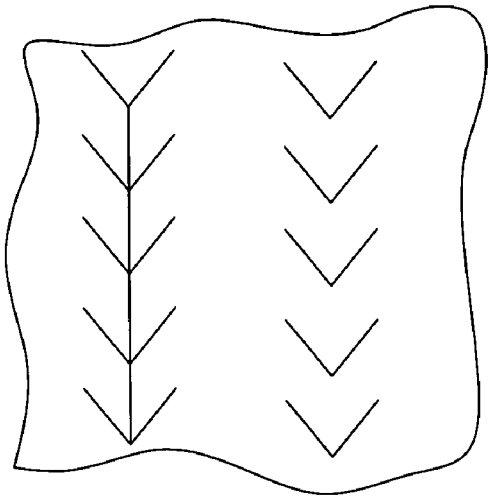
FIG. 2 shows part of a downhole filter in accordance with an embodiment of another aspect of the present invention.
Figure 3:
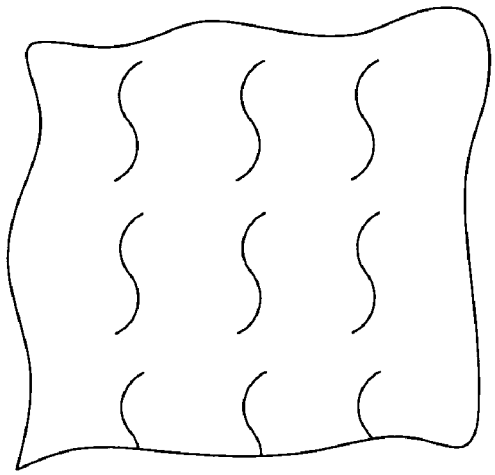
FIG. 3 shows part of a downhole filter in accordance with an embodiment of a further aspect of the present invention.

Reference is now made to FIGS. 2 and 3 of the drawings, which shows alternative, serpentine, slot forms, in particular a chevron-form in FIG. 2, and a sine wave-form in FIG. 3. If desired, the tubulars may be reinforced by providing reinforcing ribs, which may be integral with the tubing wall or welded or otherwise fixed thereto, allowing a greater density of slots, thus providing a high-inlet-flow area. The ribs may extend in any desired direction, depending upon the nature of the reinforcement which is required or desired. In other embodiments, the wall of the tubular may be corrugated, to increase crush resistance, as described in applicant's PCT\GB2003\002880, the disclosure of which is incorporated herein by reference.

Figure 4:
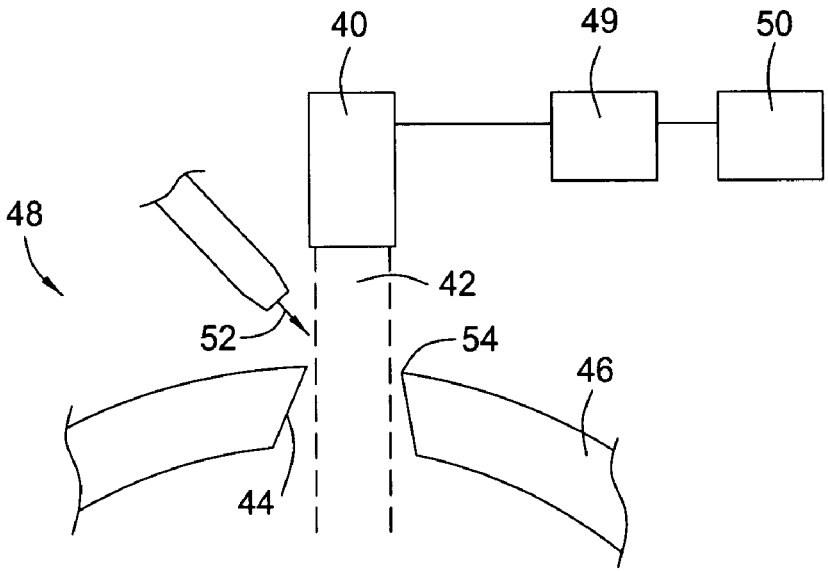
FIG. 4 is a schematic view of a step in the creation of a filter in accordance with an embodiment of a still further aspect of the present invention.

Reference is now made to FIG. 4 of the drawings, which is a schematic view of a step in the creation of a filter in accordance with an embodiment of a still further aspect of the present invention. In particular, the figure shows a laser-cutting operation, with a laser-cutting head 40 producing an energy beam 42 which is utilised to cut a slot 44 in the wall 46 of a metal tubular 48.

The head 40 and tubular 48 are mounted for relative movement to permit the desired slot forms to be cut, whether these are longitudinal slots, circumferential slots, or serpentine slots. The energy input to the head 40 from the associated power source 50 is controlled by a computer-controlled unit 49 such that, when the head 40 is producing an energy beam and is stationary relative to the tubular 48, the energy input is reduced such that the resulting slot width is the same as that produced when the head 40 is cutting a slot while moving relative to the tubular 48.

The laser-cutting head 40 is provided in conjunction with a purge gas outlet, from which a jet of inert gas 52 is directed onto and around the cutting area. This gas 52 protects the hot metal from oxidation and also carries away the vaporised and molten metal produced by the cutting operation. The gas 52 also has the effect of rapidly cooling the hot metal in the vicinity of the cut. The resulting quenching effect has been found to harden the metal, and in particular has been found to harden the slot outer edges 54. The hardening of the metal in the vicinity of the cut may cause the slot to become more resistant to erosion.

Figure 5:
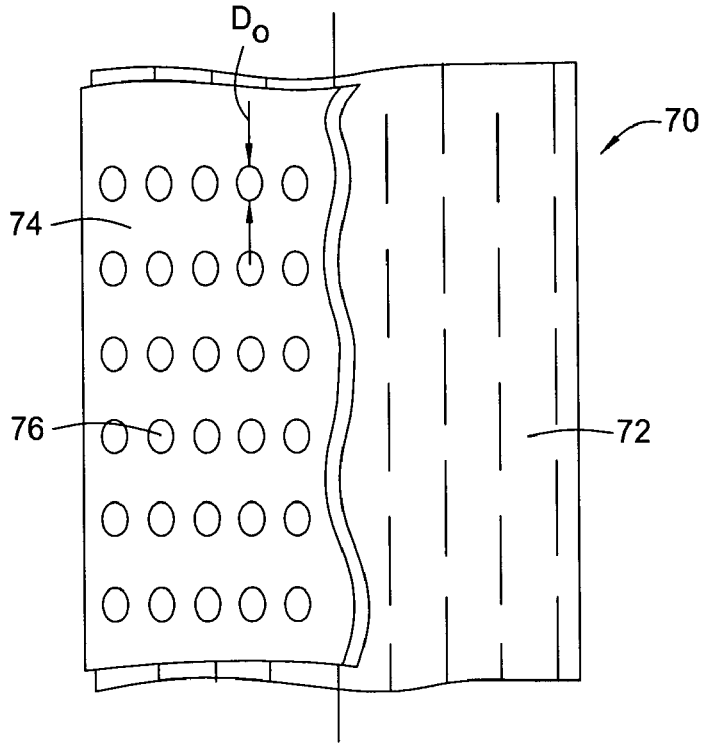
FIG. 5 is a schematic illustration of part of a filter in accordance with an embodiment of another aspect of the present invention.

FIG. 5 is a part-sectional illustration of part of another form of laser-cut filter, and in particular shows part of an expandable downhole filter arrangement 70 comprising an expandable slotted base tube 72 and a deformable metal filter sheet 74 mounted over and around the base tube 72, the filter sheet 74 defining a plurality of laser-cut perforations 76. The laser-perforated sheet 74 is initially provided in planar form, and then wrapped around the base tube 72. The edges of the sheet may be joined by any convenient method, such as a seam weld.

Figure 6:
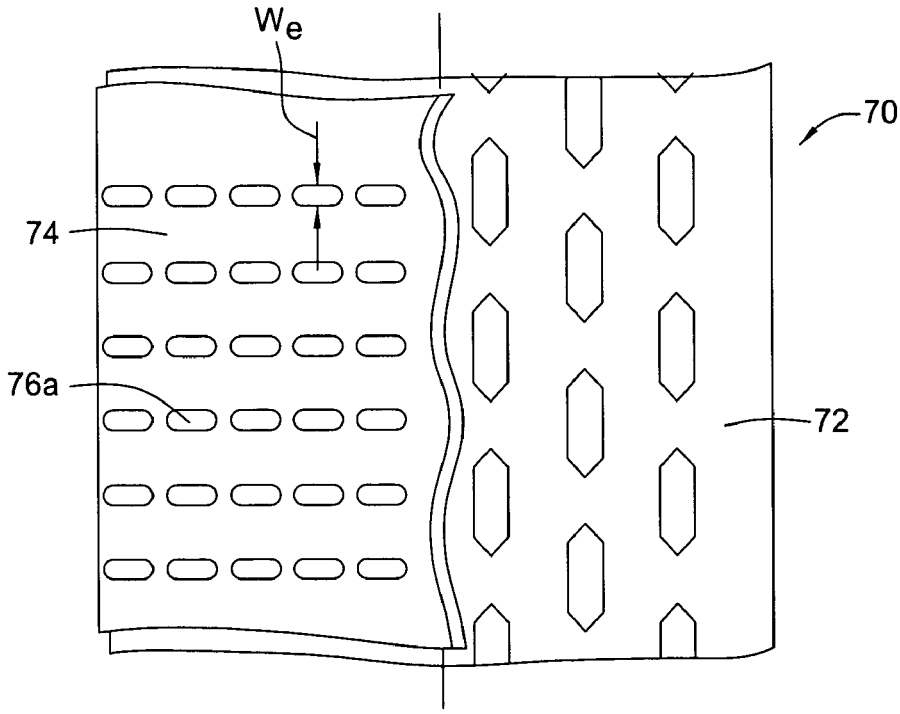
FIG. 6 is a view of part of a filter sheet of the filter of FIG. 5, shown following diametric expansion of the filter.

It will be noted that the perforations 76 are substantially circular, and on expansion of the filter arrangement 70 to a larger diameter, with corresponding diametric expansion of the filter sheet 74, the perforations 76 assume the form of elongate slots 76*a*, as illustrated in FIG. 6 of the drawings, of width $W_e$ less than the diameter $D_o$ of the original perforations. The diametric expansion may be achieved by any convenient method, but the method preferably utilizes a rotary expansion tool.

The laser-cut perforations 76 have a keystone or trapezoidal section, which form is retained in the extended slots 76*a*, and the filter sheet 74 is arranged such that the narrower or smaller diameter end of the perforations is adjacent the outer face of the filter sheet. It has been found that the laser-perforated filter sheet 74 is sufficiently robust to obviate the requirement to provide a protective shroud around the exterior of the sheet 74, thus simplifying the manufacture of the expandable filter arrangement 70 and allowing installation of the filter arrangement 70 within the wellbore 12 without the tear-prone protective outer shroud.

Figure 7:
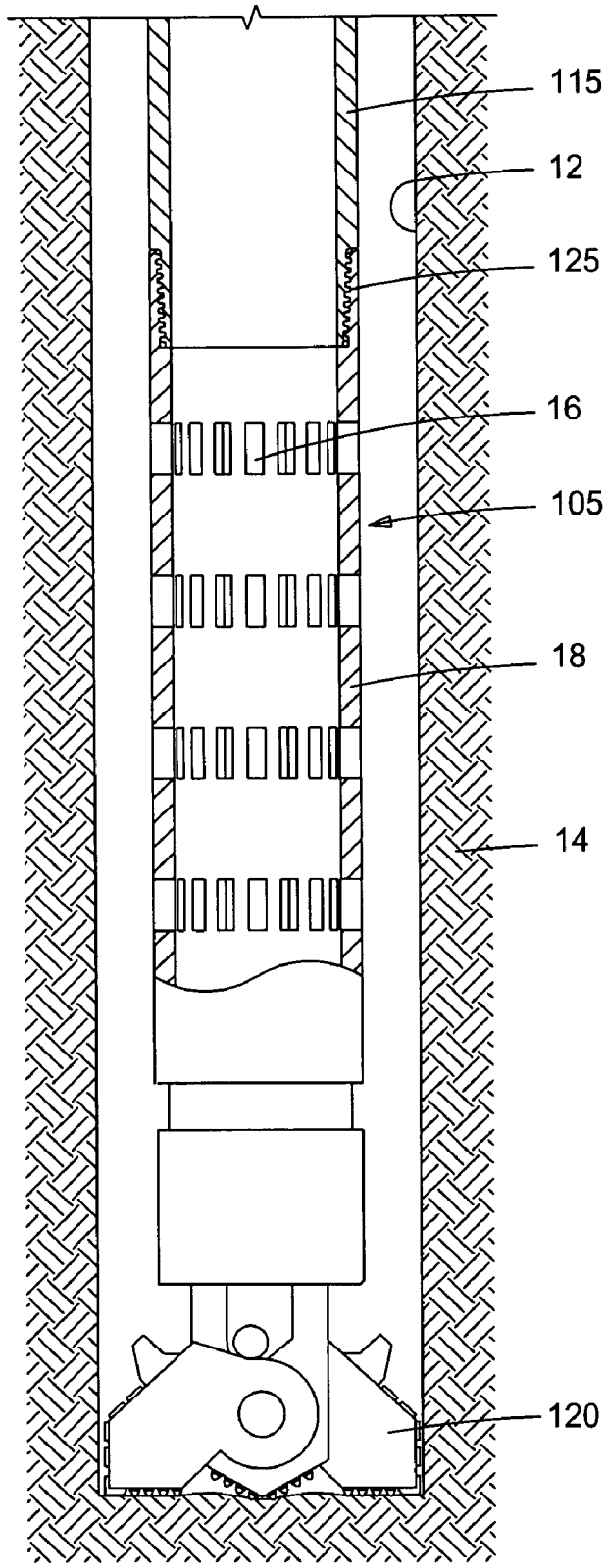
FIG. 7 is a schematic sectional view of part of the downhole filter of FIG. 1 drilling a wellbore within a formation.

FIG. 7 shows a tubular string 105 being lowered into the wellbore 12. The tubular string 105 may be a drill string if it is used to form the wellbore 12 in the formation 14 (as shown in FIG. 7) or in another embodiment, may be a tubular string 105 lowered into the wellbore 12 after the wellbore 12 has been drilled in the formation 14 (a completion string for example).

The tubular string 105 includes a non-porous tubing portion 115 and a porous tubing portion 18 operatively connected to one another, preferably connected to one another by a threaded connection 125. The porous tubing portion 18 preferably acts as a downhole filter for fluid entering a bore of the tubular string 105 from the formation 14. One or more openings 16, which are preferably one or more perforations or one or more slots, are located within the tubular wall of the porous tubing portion 18.

The openings 16 are preferably formed in the porous tubing portion 18 in the same manner as described in relation to FIGS. 1–6 above and are preferably configured in the shape as shown and described in relation to FIGS. 1 and 2; however, it is contemplated that the openings 16 may be formed in any other manner known to those skilled in the art and that the openings 16 may be configured as shown and described in relation to FIGS. 3–6 or in any other shape and size known to those skilled in the art. The openings 16 are preferably formed by laser-cutting or abrasive water jet cutting, but may be created by any conventional cutting or milling techniques.

Because the tubular string 105 shown in FIG. 7 is used to drill into the formation 14, an earth removal member 120 is operatively connected to a lower end of the tubular string 105. The earth removal member 120 is preferably a drill bit and has one or more perforations therethrough for circulating drilling fluid while drilling. The tubular string 105 may further include a mud motor (not shown) and/or other traditional components of a bottomhole assembly disposed above the earth removal member 120 to impart rotation to the earth removal member 120 and/or to perform other functions such as measuring-while-drilling or logging-while-drilling. The earth removal member 120 may be rotated relative to the tubular string 105 using the mud motor to drill into the formation 14, or in the alternative, the entire tubular string 105 may be rotated by equipment capable of providing torque to the tubular string 105, for example a top drive or one or more tongs.

In the alternate embodiment in which the wellbore 12 is drilled to the desired depth prior to insertion of the tubular string 105 into the wellbore 12, the earth removal member 120 is preferably not included at the lower end of the tubular string 105. Moreover, in the alternate embodiment, the tubular string 105 does not have to be rotated, and drilling fluid does not have to be circulated during lowering of the tubular string 105.

In operation, the tubular string 105 is assembled at the surface of the wellbore 12 so that the porous tubing portion 18 will ultimately be disposed substantially adjacent to the fluid-bearing portion of the formation 14, which is the "area of interest" in the formation 14. The tubular string 105 may include any number of porous tubing portions 18 and any number of non-porous tubing portions 115 connected in any order to one another. In assembling the tubular string 105 at the surface, the porous tubing portion 18 is selected based on the quantity, shape, and size of openings 16 needed to filter the fluid flowing from the area of interest in the formation 14 to the desired extent, and the length of the porous tubing portion 18 is selected based on the desired flow-filtering area of the downhole filter.

Instead of assembling the tubular string 105 at the surface, the tubular string 105 may be assembled as portions of the tubular string 105 are lowered into the wellbore 12, for example by threadedly connecting porous and non-porous tubing portions 18, 115 as the upper end of the preceding tubular portion becomes accessible. Whether assembled at the surface or while the tubular string 105 is lowered into the wellbore 12, the porous tubing portions 18 need not be alike in quantity, shape, or size of the openings 16 or length over which the openings 16 extend along the tubular string 105. For example, if more than one area of interest exists in the formation 14, one porous tubing portion 18 may be configured in one way, while another porous tubing portion 18 may be configured in another way, so that each porous tubing portion 18 is configured to adequately filter the different area of interest to which it is disposed adjacent.

As shown in FIG. 7, the tubular string 105 is then lowered into the formation 14 to form a wellbore 12. As stated above, the earth removal member 120 may be rotated or the entire tubular string 105 rotated to form the wellbore 12 and install the tubular string 105 within the wellbore 12. Optionally, drilling fluid may be introduced into the tubular string 105 and circulated through the perforations in the earth removal member 120 up through an annulus between the outer diameter of the tubular string 105 and a wall of the wellbore 12 while drilling.

The tubular string 105 is used to drill the wellbore 12 until the porous tubing portion 18 is positioned at least substantially adjacent to the area of interest in the formation 14. In one embodiment, the earth removal member 120 may remain within the wellbore 12 after drilling the tubular string 105 to the area of interest. In an alternative embodiment, the earth removal member 120 may be retrieved from the wellbore 12, for example by any fishing tool known to those skilled in the art capable of retrieving a drill bit. In a further alternative embodiment, the earth removal member 120 may be drilled through by another cutting tool.

If the wellbore 12 was drilled prior to insertion of the tubular string 105 into the wellbore 12, as in the alternate embodiment, the tubular string 105 is lowered into the previously drilled-out wellbore 12 to a position substantially adjacent to the area of interest within the formation 14. Because the earth removal member 120 is not present in this embodiment, no procedure is necessary to remove the earth removal member 120 from the wellbore 12.

At this point in the operation, the fluid may flow through the openings 16 from the area of interest in the formation 14 into the bore of the tubular string 105. As the fluid flows through the openings 16, the fluid is filtered so that wellbore particulate matter is prevented from entering the bore of the tubular string 105 to the extent desired. The filtered fluid may then flow up through the bore of the tubular string 105 to the surface of the wellbore 12.

Figure 8:
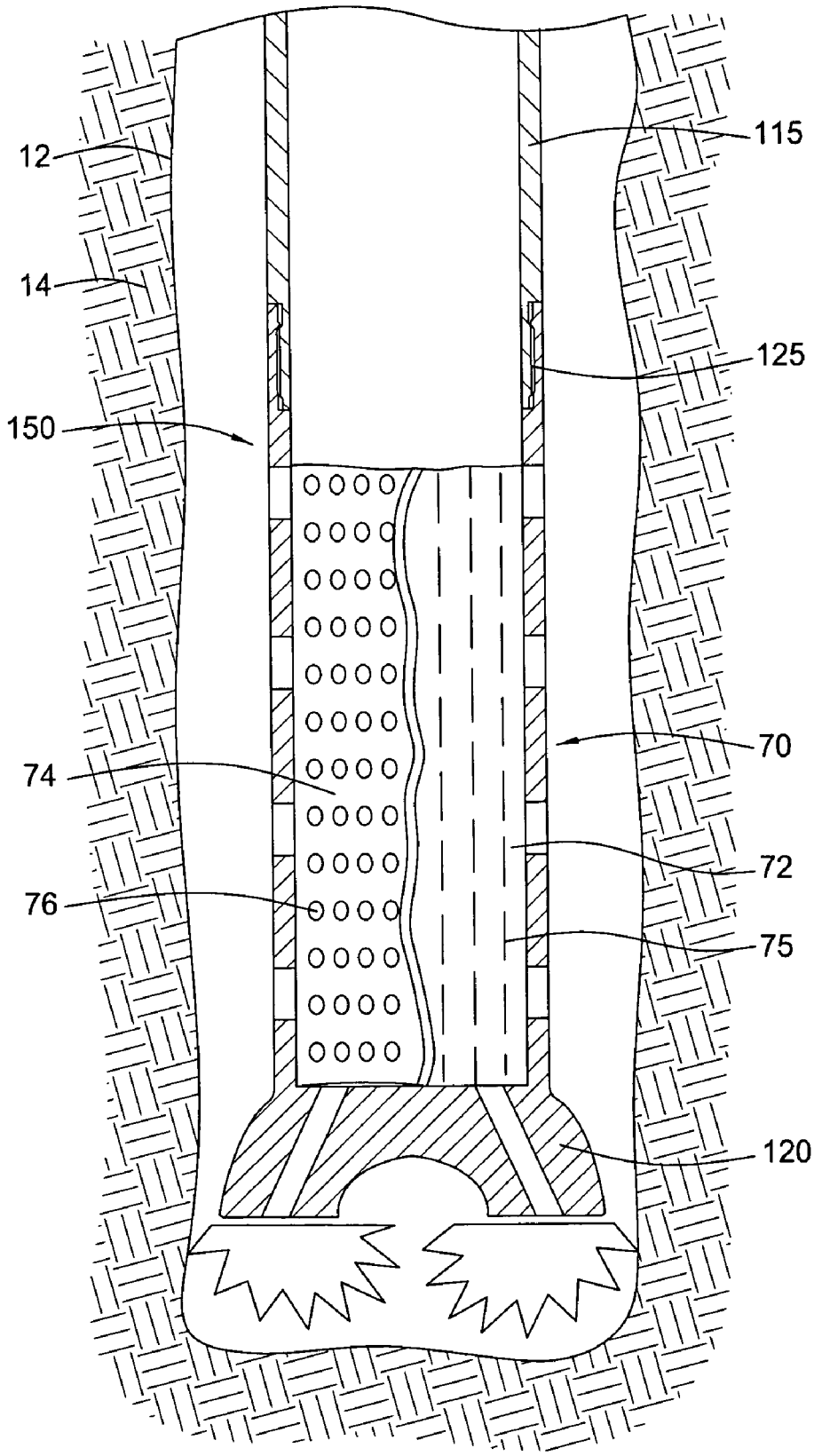
FIG. 8 is a schematic sectional view of part of the downhole filter of FIG. 5 drilling a wellbore within a formation.
Figure 9:
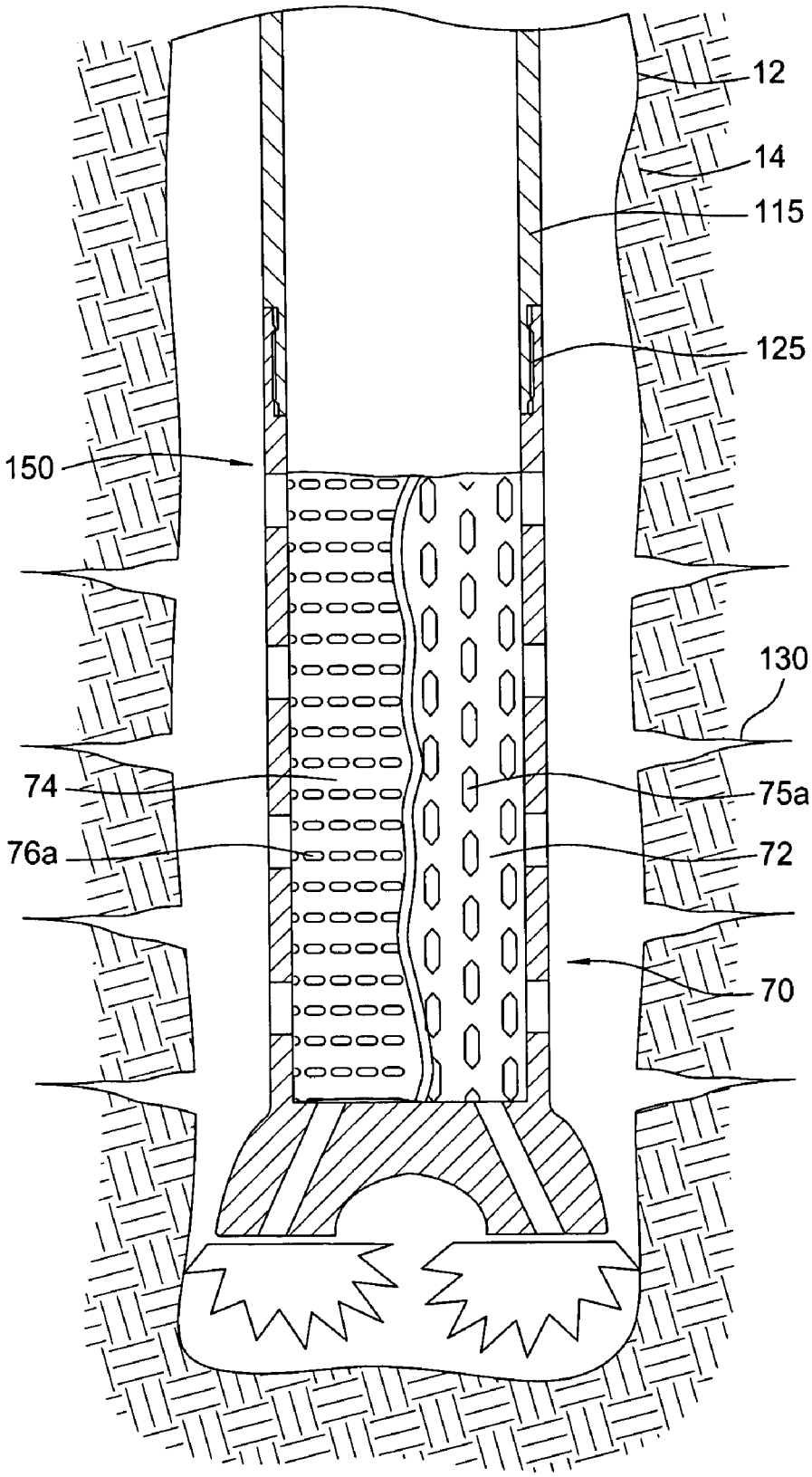
FIG. 9 is a schematic section view of part of the downhole filter of FIG. 5 positioned within the wellbore.

An additional embodiment of the present invention is shown in FIGS. 8 and 9. The embodiments shown in FIGS. 8 and 9 include an inner support pipe disposed within a porous tubular member, without any external protective shroud disposed around the tubular member. Eliminating the external protective outer shroud which is present in traditional downhole filter arrangements allows the downhole filter to be placed in the wellbore or drilled into the formation without tearing or otherwise damaging the filtering functionality of the downhole filter on obstructions encountered while lowering the downhole filter into the wellbore, such as wellbore debris, objects within the wellbore, the wellbore wall, or formation cuttings.

Referring to FIG. 8, one or more non-porous tubing portions 115 are included in a tubular string 150. Also, one or more downhole filter portions 70, which are the porous tubing portions, are included in the tubular string 150. The porous and non-porous tubing portions 70 and 115 are operatively connected to one another, preferably by one or more threaded connections 125.

The downhole filter portion 70 of FIG. 8 is preferably the downhole filter arrangement of FIG. 5, as shown and described above. Specifically, the downhole filter portion 70 preferably includes the slotted base tube 72 having one or more openings 75, preferably one or more perforations or one or more slots, therethrough as well as the filter sheet 74 surrounding the base tube 72 having one or more laser-cut openings 76 therethrough, preferably one or more perforations. The openings 75 and 76 are preferably formed within the tubing walls in the same manner as described above in relation to FIG. 5.

In the alternative, the openings 75 and 76 of the slotted base tube 72 and surrounding filter sheet 74 may be configured and formed by other methods shown or described herein or in any other manner known to those skilled in the art. Specifically, the openings 75, 76 may be formed by laser-cutting or abrasive water jet cutting, or by any conventional cutting or milling techniques.

The downhole filter 70 may be expandable as shown and described in relation to FIGS. 5 and 6, or instead may be unexpandable. The formation of the downhole filter 70 may be accomplished in any manner described herein or known to those skilled in the art.

The tubular string 150 may be a drill string as shown in FIG. 8, or may in the alternative be merely a completion string. If the tubular string 150 is a drill string used to drill the wellbore 12 in the formation 14, an earth removal member 120, preferably a drill bit, is operatively attached to the lower end of the tubular string 150. The earth removal member 120 in the embodiment of FIG. 8 is substantially the same in operation and construction as the earth removal member shown and described in relation to FIG. 7.

In operation, the tubular string 150 is assembled at the surface of the wellbore 12 or, instead, as it is being lowered into the previously-drilled wellbore 12 so that the porous tubing portion 70 will be located substantially adjacent the area of interest in the formation 14, as described above in relation to the embodiment of FIG. 7. The tubular string 150 may include any number of porous tubing portions 70 and any number of non-porous tubing portions 115 connected in any order to one another. The porous tubing portions 70 are not required to be the same types of porous tubing, but rather some may include the slotted base tube 72 and surrounding filter sheet 74 while others may include merely slotted or perforated tubing without the surrounding filter sheet.

When assembling the tubular string 150, the porous tubing portions 70 are selected and formed based on the quantity, shape, and size of openings 75, 76 necessary to filter the fluid flowing from the area of interest in the formation 14 to the desired extent, and the length and location of the porous tubing portions 70 in the tubular string 150 are selected based on the desired flow-filtering area of the downhole filter 70. If the tubular string 150 is expandable, the size and shape of the openings 75, 76 of the porous tubing portions 70 subsequent to expansion are taken into account when selecting the characteristics of the openings 75, 76 of the pre-expansion porous tubing portions 70.

After or while the tubular string 150 is assembled, the tubular string 150 is lowered into the wellbore 12. If the tubular string 150 is used to drill into the formation 14, as shown in FIG. 8, the earth removal member 120 and/or the tubular string 150 may be rotated while lowering the tubular string 150 into the formation 14 to form a wellbore 12. The tubular string 150 is installed within the wellbore 12 substantially adjacent to the area of interest within the formation 14 having one or more perforations 130 therethrough, as shown in FIG. 9.

In the embodiment in which the tubular string 150 is not expanded, the earth removal member 120 may optionally be removed from the wellbore 12 by retrieving it with the fishing tool, as described above in relation to FIG. 7, or by drilling through the earth removal member 120 with a subsequent cutting tool. Fluid may then flow from the formation 14 into the wellbore 12 through the perforations 130, through the openings 76 in the filter sheet 74, and then through the openings 75 into the bore of the slotted base tube 72, then up to the surface of the wellbore 12. The downhole filter 70 prevents wellbore particulate matter from entering the bore of the tubular string 150 to the extent desired when fluid flows from within the wellbore 12 into the tubular string 150 through the openings 75 and 76.

In the alternate embodiment where the tubular string 150 is installed within the wellbore 12 after the wellbore 12 has previously been formed, the porous tubing portion 70 is merely positioned substantially adjacent to the area of interest within the previously drilled-out wellbore 12. Fluid may then flow through the tubular string 150 as described in the previous paragraph.

FIG. 9 shows an alternate embodiment where the tubular string 150 is expanded within the wellbore 12. An expander tool such as the expander tool shown and described in U.S. Pat. No. 6,702,030 filed on Aug. 13, 2002, which is herein incorporated by reference in its entirety, may be utilized to expand the tubular string 150. In other embodiments, any other type of expanding method known to those skilled in the art, such as expansion by a mechanical, cone-type expander tool or by internal pressure, may be utilized to expand the tubular string 150 within the wellbore 12.

When the earth removal member 120 (see FIG. 8) is attached to the tubular string 150 to drill into the wellbore 12, the earth removal member 120 may be removed prior to expansion of the tubular string 150. As described above in relation to FIGS. 5 and 6, the openings 76 upon expansion become elongate slots 76*a*, while the openings 75 become extended openings 75*a*. Upon expansion, the openings 75*a* preferably are keystone-shaped or trapezoidal-shaped slots. After expansion of the tubular string 150, fluid may flow from the area of interest into the tubular string 150 as described above.

While the embodiment shown in FIG. 9 is described above as an expanded tubular string, the tubular string 150 in other embodiments may be lowered or drilled into the wellbore 12 with the openings 75*a*, 76*a* predisposed in the shapes and sizes shown in FIG. 9 without the requirement to expand the tubular string 150 downhole. Also in yet other embodiments, the openings 75*a* and 76*a* may be formed by any method or in any other shape, size, density on the tubular string 150, or length of the tubular string 150 desired which is described herein in relation to any of FIGS. 1–6.

If it is desired to retrieve the earth removal member 120 utilized in embodiments shown and described in relation to FIGS. 7–9, the earth removal member 120 may be an expandable and retractable drill bit such as those described in U.S. patent application Ser. No. 10/296,956 filed on Nov. 26, 2002 or in U.S. patent application Ser. No. 10/276,089 filed on Nov. 15, 2002, both of which applications are herein incorporated by reference in their entirety. If it is desired to drill through the earth removal member 120 utilized in embodiments shown and described in relation to FIGS. 7–9, the earth removal member 120 may be a drillable drill bit such as described in U.S. patent application Ser. No. 10/168,676 filed on Dec. 21, 2000, which is herein incorporated by reference in its entirety.

In the embodiments shown above with regards to FIGS. 8 and 9, the filter sheet 74 may be substantially non-porous. Additionally, the filter sheet 74, whether substantially non-porous or porous, may be removable from the base tube 72.

As described above, the "tubular" and "tubing" may comprise any type of pipe, casing, or other tubular body. The above embodiments of downhole filters may be employed in open hole wellbores as well as cased wellbores. Furthermore, although the above description uses directional terms such as "lowering" and "depth", embodiments of the present invention are not limited to these particular directions or to a vertical wellbore, but are merely terms used to describe relative positions within the wellbore. Specifically, it is within the purview of embodiments of the present invention to be applied to use in a lateral wellbore, horizontal wellbore, or any other directionally-drilled wellbore to describe relative positions of objects within the wellbore and relative movements of objects within the wellbore.

Those of skill in the art will appreciate that the above-described embodiments are merely exemplary of the present invention, and that various modifications and improvements may be made thereto without departing from the scope of the invention. For example, although the various filters and filter arrangements are described above with reference to downhole filtering applications, other embodiments may have utility in sub-sea or surface filtering applications.

While the foregoing is directed to embodiments of the present invention, other and further embodiments of the invention may be devised without departing from the basic scope thereof, and the scope thereof is determined by the claims that follow.

The invention claimed is:

1. A method of drilling a wellbore through a fluid producing formation, comprising:

providing a drill string having at least one filter section and a drilling member at a lower end thereof, wherein a wall of the at least one filter section defines an inner diameter of the drill string;

supporting the drilling member with the drill string;

forming the wellbore such that at least one of the at least one filter section is located in the fluid producing formation; and radially expanding the at least one filter section.

2. The method of claim 1, further comprising leaving at least a portion of the drill string in the wellbore.

3. The method of claim 1, further comprising removing the drilling member from the wellbore.

4. The method of claim 1, further comprising communicating a fluid between an interior and an exterior of the drill string through the at least one filter section while forming the wellbore.

5. The method of claim 1, wherein one or more filter sheets are disposed around the at least one filter section.

6. The method of claim 5, wherein the one or more filter sheets are porous.

7. The method of claim 5, further comprising removing the one or more filter sheets from the at least one filter section.

8. The method of claim 5, wherein the one or more filter sheets comprise one or more coatings.

9. The method of claim 1, wherein the at least one filter section retains its filtering ability after expansion.

10. The method of claim 1, further comprising radially expanding a non-filter section of the drill string.

11. The method of claim 1, further comprising filtering fluid flowing from the fluid-producing formation into a bore of the drill string using the at least one filter section.

12. The method of claim 1, wherein the at least one filter section comprises one or more apertures having an outer width less than an inner width.

13. The method of claim 1, wherein the at least one filter section comprises at least one laser-cut aperture therein.

14. The method of claim 1, wherein providing the drill string comprises laser cutting at least one aperture in the at least one filter section.

15. The method of claim 14, further comprising controlling a laser energy while laser cutting the at least one aperture.

16. The method of claim 14, wherein providing the drill string further comprises directing an inert gas proximate to the at least one aperture to control erosion of the at least one aperture.

17. The method of claim 14, wherein providing the drill string further comprises hardening a surface of the at least one aperture to control erosion of the at least one aperture.

18. A method of drilling a wellbore through a fluid producing formation, comprising:

providing a drill string, having:

a drilling member; and a wall having a filter section, wherein the wall supports the drilling member and defines an inner diameter of the drill string, and wherein the filter section comprises a tubular having one or more openings and a filter layer surrounding the tubular;

forming the wellbore by rotating the drilling member such that the filter section is located in the fluid producing formation; and expanding at least a portion of the filter section.

19. The method of claim 18, wherein the rotating the drill string comprises rotating the filter section.

20. The method of claim 18, further comprising communicating a fluid between an interior and an exterior of the drill string through the at least one filter section while forming the wellbore.

21. The method of claim 18, wherein the one or more openings are formed by laser cutting.

22. The method of claim 21, wherein the one or more openings comprise slots.

23. The method of claim 21, wherein a flow of energy used to laser-cut the one or more openings is reduced while a source of the flow of energy is stationary relative to the filter section, thereby retaining uniformity of size of the one or more openings.

24. The method of claim 21, further comprising flowing inert gas onto the one or more openings to harden the one or more openings.

25. The method of claim 24, wherein flowing inert gas onto the one or more openings substantially prevents erosion of the one or more openings.

26. The method of claim 18, further comprising filtering fluid flowing from the fluid-producing formation into a bore of the drill string using the filter section.

27. The method of claim 18, further comprising surrounding the filter section with a substantially non-porous outer shroud.

28. The method of claim 27, wherein the outer shroud is removable.

29. The method of claim 18, wherein the filter section comprise one or more laser liners.

30. The method of claim 18, wherein the filter section comprises one or more sand screens.

31. The method of claim 18, wherein the drilling member is drillable.

32. The method of claim 18, wherein the drilling member is retrievable through the drill string.

33. The method of claim 18, wherein the one or more openings are formed by abrasive water jet cutting.

34. The method of claim 18, wherein expanding at least a portion of the filter section changes a geometry of the one or more openings.

35. The method of claim 18, wherein the filter layer comprises one or more well screens.

36. The method of claim 18, further comprising controlling the size and geometry of the one or more openings to optimize the ability of the filter section to filter sand from fluid flowing from the fluid-producing formation into a bore of the drill string through the one or more openings.

37. The method of claim 36, wherein controlling the size and geometry of the one or more openings comprises forming the one or more openings without sacrificing a filtering integrity of the filter section.

38. The method of claim 18, wherein a geometry of the one or more openings is keystone-shaped.

39. The method of claim 18, wherein the one or more openings have an outer width less than an inner width.

40. The method of claim 18, wherein a geometry of the one or more openings is trapezoidal.

41. A method of drilling a wellbore through a fluid producing formation, comprising:

providing a drill string having at least one porous section and a drilling member at a lower end thereof, the porous section having a removable filter member on an inside diameter thereof;

forming the wellbore such that at least one of the at least one porous section is located in the fluid producing formation; and removing the filter member from the at least one porous section.

* * * * *